US005286112A

United States Patent [19]

Bible

[11] Patent Number: 5,286,112

[45] Date of Patent: Feb. 15, 1994

[54] LOCKING FASTENER AND METHOD

[76] Inventor: Kenneth G. Bible, 201 Butler Dr., Greenvile, S.C. 29611

[21] Appl. No.: 930,804

[22] Filed: Aug. 17, 1992

[51] Int. Cl.[5] ..... B65D 33/16

[52] U.S. Cl. ..... 383/86; 24/306; 24/442

[58] Field of Search ..... 24/442, 306; 2/DIG. 6, 2/60, 141 R, 141 A; 128/DIG. 15; 224/901; 383/86

[56] References Cited

U.S. PATENT DOCUMENTS

| | | | |
|---|---|---|---|
| 3,178,559 | 4/1965 | Fogel et al. | 128/DIG. 15 |
| 3,241,881 | 3/1966 | Larnahan et al. | 24/306 X |
| 3,256,882 | 6/1966 | Huber | 128/DIG. 15 |
| 4,422,455 | 12/1983 | Olsen | 128/DIG. 15 |
| 4,893,381 | 1/1990 | Frankel | 24/442 X |
| 5,076,288 | 12/1991 | Millard et al. | 128/DIG. 15 |

*Primary Examiner*—James R. Brittain
*Attorney, Agent, or Firm*—Dority & Manning

[57] ABSTRACT

A first fastener member has hook fastener material (B) for securement to a second fastener member having opposed loop fastener material (D). A transverse hinge (E) fixes the first fastener member in position opposite the second fastener for securement of the respective hook and loop fastener materials. By pulling the first hinged fastener member outwardly with the second fastener member, release of the securement of the respective fastener materials may be facilitated.

25 Claims, 6 Drawing Sheets

LOCKING FASTENER AND METHOD

BACKGROUND OF THE INVENTION

This invention relates to improved fasteners such as Velcro fasteners having a locking capability, and to a method of securing and unsecuring contact fasteners. Contact fasteners such as those making use of hook and loop fastener materials as in Velcro fasteners possess the disadvantage of becoming loosened should an inadvertent pull occur upon an elements carrying fastener material.

Attempts have been made to increase the versatility of Velcro fasteners which have included the use of hinged members. The following prior U.S. Pat. Nos. illustrate the state of the art: 3,543,977; 3,827,107; 3,947,927; 4,862,563; and 4,893,381.

The locking fastener and method hereof may be utilized as a fastening device and method in the device of my copending United States patent application entitled RESTRAINING AND PROTECTIVE DEVICE AND METHOD, filed Apr. 10, 1992, and bearing Ser. No. 07/866,973.

Accordingly, an important object of this invention is to provide an improved fastener such as a Velcro fastener and the like, with a locking feature and a method for applying and releasing the locking action.

Another important object of this invention is to provide a Velcro fastener and the like having at least one hinged locking fastener member which is free except for fixation at the hinge while a second movable fastener member having opposed fastener material is carried opposite the hinged members.

The invention contemplates the provision of a Velcro fastener having a hinged member carried in fixed relation to a movable member each member having opposed respective fastener material so that when an attempt is made to pull outwardly on the second member, the hinged member is pulled outwardly against the hinge so as to avoid action tending to release the second strap member except by peeling away the hinged member releasing same.

By utilizing the method of the present invention, the free strap member may be pulled outwardly carried with a free end of the hinge member which facilitates the peeling away of the hinge member with release of the Velcro fastener.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a locking fastener having respective hook and loop fastening material. A first width of backing A has fastener material B on one surface. A second width of backing C, providing a movable member in overlying relation to the first width A, has complementary fastener material D on an opposite surface. The first width of flexible backing serves as a locking member having a fixed end. A transverse hinge E fastens the first width of backing in fixed relation providing the fixed end opposite the second width of flexible backing in alignment therewith having the fastener material on the one surface in position engaging the fastener material on the opposite surface.

Thus, the first and second widths of backing may be fastened together by securement of the respective fastener material so that an attempt to dislodge the securement of the respective fastener material results in pivoting said first width of backing outwardly on said hinge for limiting release of the fastener.

Preferably the fastener material on the first width of backing is hook material and the fastener material on the second width of backing is loop material. The backing may be provided in the form of webbing or any other suitable Velcro fastener backing material. A tab F free of fastener material is carried on a free end of the first width of backing to facilitate peeling away of the hinged width of backing material.

The method contemplates securement of a contact fastener such as Velcro utilizing a hinged fastener member in fixed relation opposite a movable fastener member, pulling the fastener member, pulling the movable fastener outwardly, and separating the hinged fastener member opposite the hinge from the movable fastener member.

Figure 1:
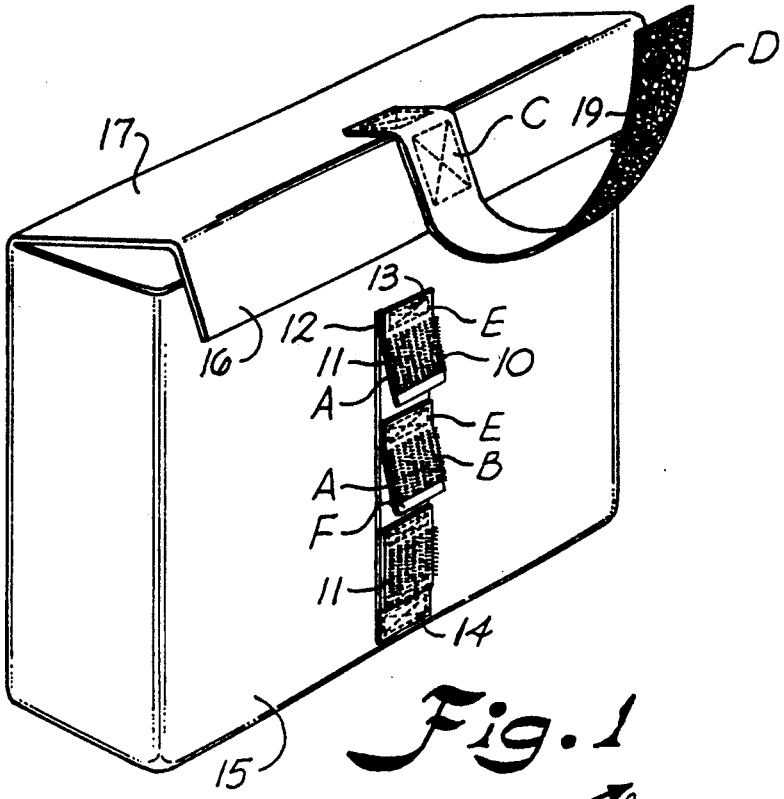
FIG. 1 is a perspective view illustrating a Velcro looking fastener constructed in accordance with the present invention carried by a bag suitable for travel and having multiple hinged locking fastener elements.
Figure 2:
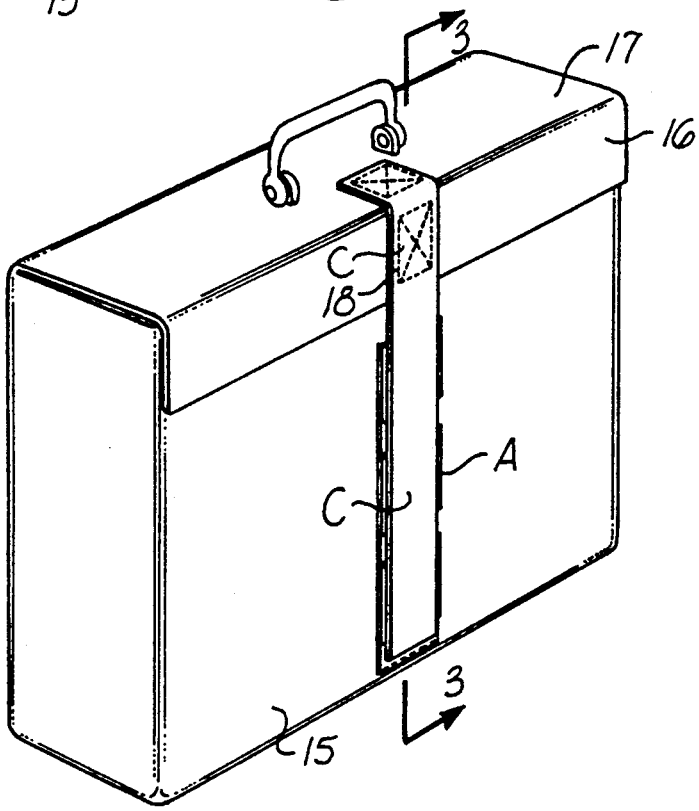
FIG. 2 is a perspective view illustrating the fastener of FIG. 1 carried upon the bag in locking position.
Figure 3:
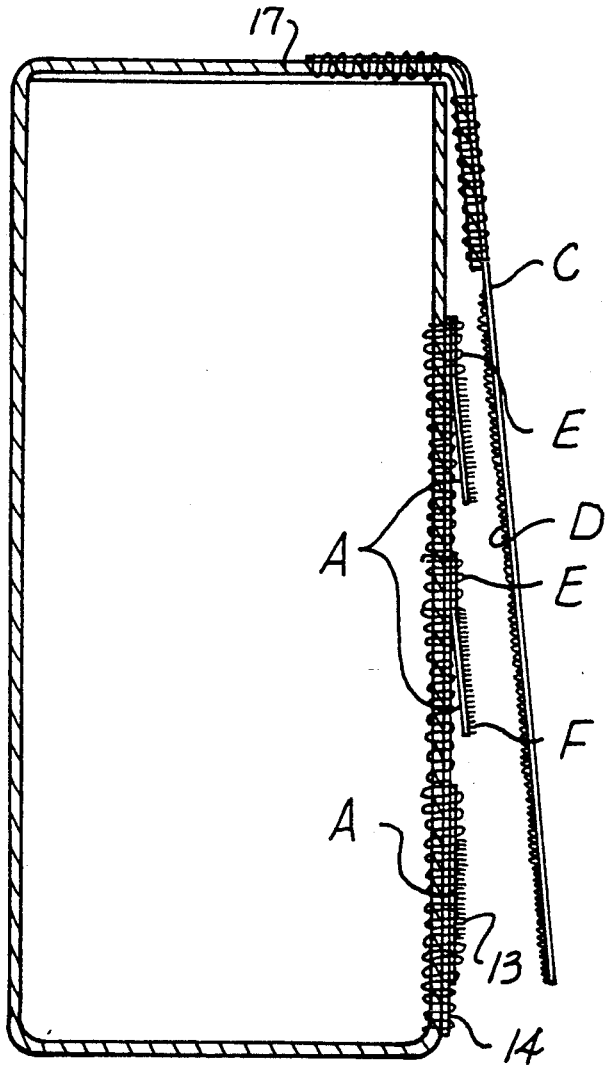
FIG. 3 is an enlarged transverse sectional elevation taken on the line 3—3 FIG. 2.

Referring more particularly to FIG. 1, a plurality of sequentially aligned hinged members A are provided carried in fixed hinged relation with backing such as tape webbing material 10. The tape webbing material carries fastener material B thereon preferably in the form of hook Velcro member 11. It is preferable that the hook members be carried by the fixed part of the Velcro fastener rather than the second or movable strip because the loop fastener material is more readily handled by an individual unfastening the Velcro fastener than if the hook and loop fastener material were reversed. The hinged members are illustrated as being attached to a Velcro strip 12 having hook fastener material 13 thereon. This strip 12 is illustrated as being securely attached to another object such as a bag as by sewing as at 14. The backing of the hinged backing members A is smooth as illustrated at 14 so as not to engage hook fastener members 13 carried by the strip 12.

Figure 4:
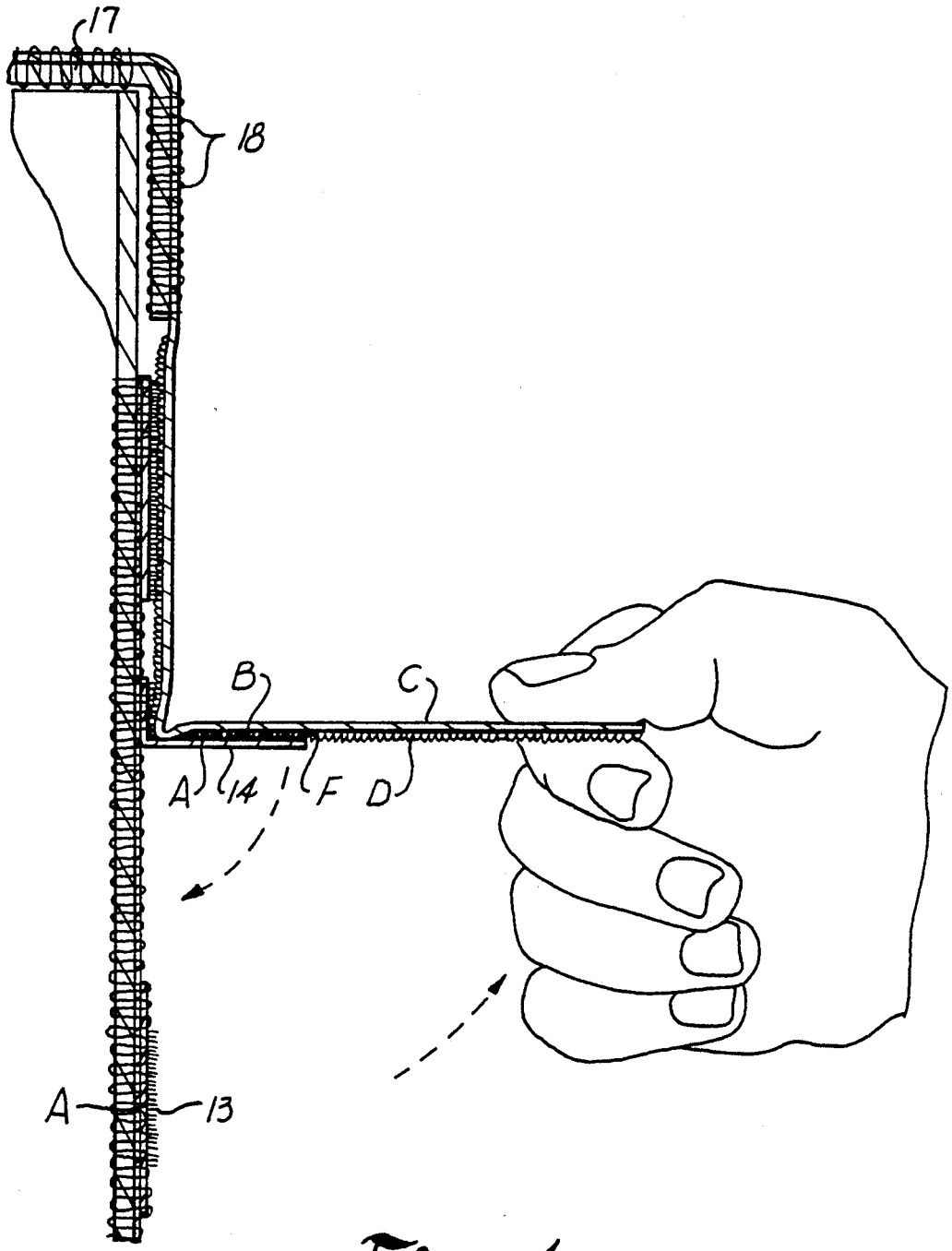
FIG. 4 is an enlarged sectional elevation similar to FIG. 3 with parts omitted further illustrating the locking feature and the method of unlocking so as to release the Velcro fastener.

The bag is illustrated as having a flat front 15 surface for receiving the Velcro strip 12 which is secured thereto as by suitable securement by sewing at 14. The bag is further illustrated as having a flap 16 and a top 17 for fixedly receiving one end of the second free or movable improved strip which includes the backing C. The free strip is attached as by suitable sewing as at 18 to the top 17. The movable strip C has Velcro loop members illustrated at 19 on the underside thereof opposite the hook members of the fastener strip 12 and hinged members A. The hinged backing members A are illustrated in FIG. 4 as being raised after the hook 13 is released from the loop fastening material D on the underside of the movable backing strip C. The hinged member A is illustrated in FIG. 4 as including a tab F to facilitate its being pulled downwardly in the direction of the arrow for unfastening the respective Velcro fastener elements and thus releasing the locking device.

Figure 5:
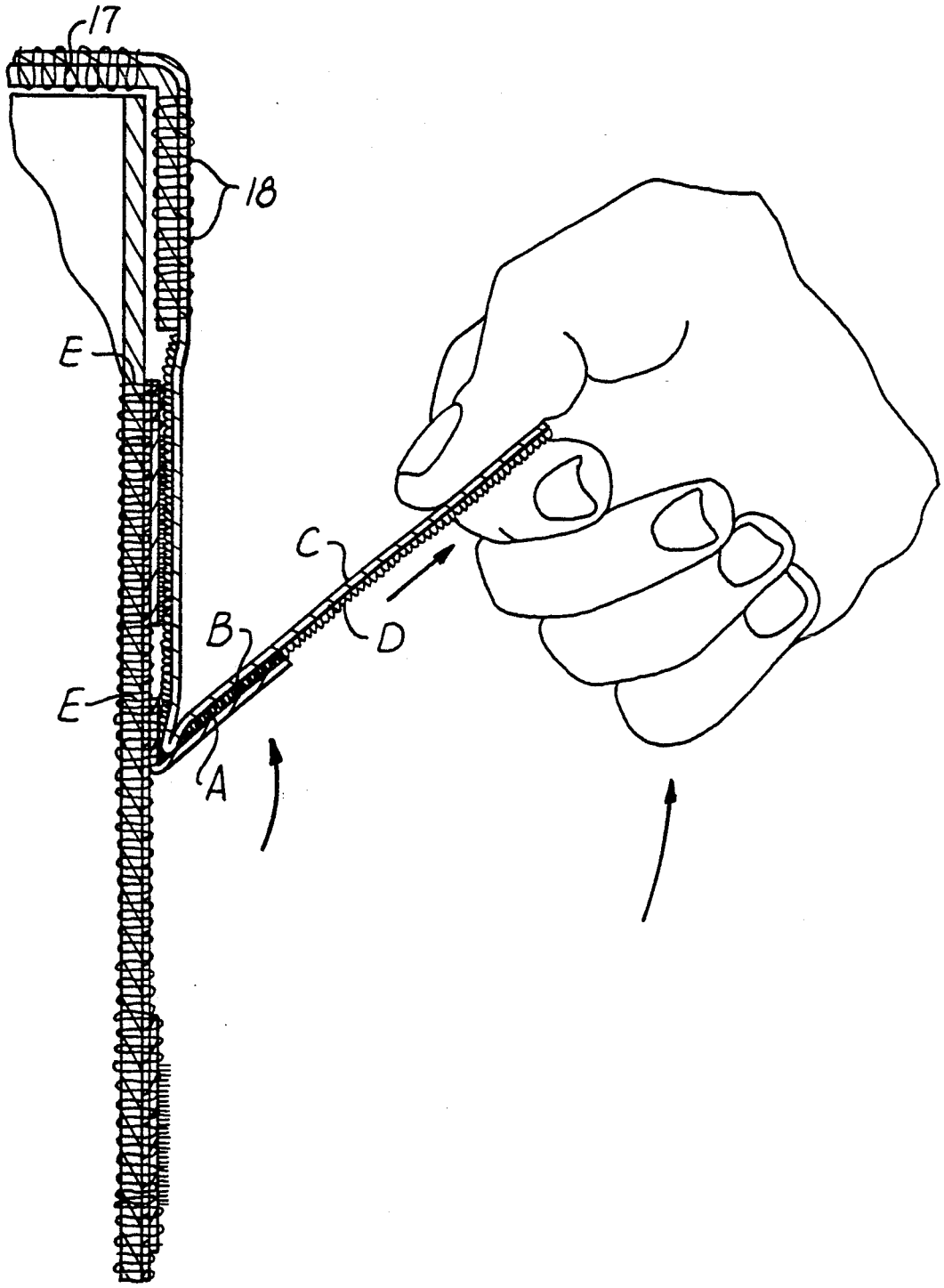
FIG. 5 is a sectional elevation similar to FIG. 4 illustrating a further step in unfastening the Velcro fastener.
Figure 6:
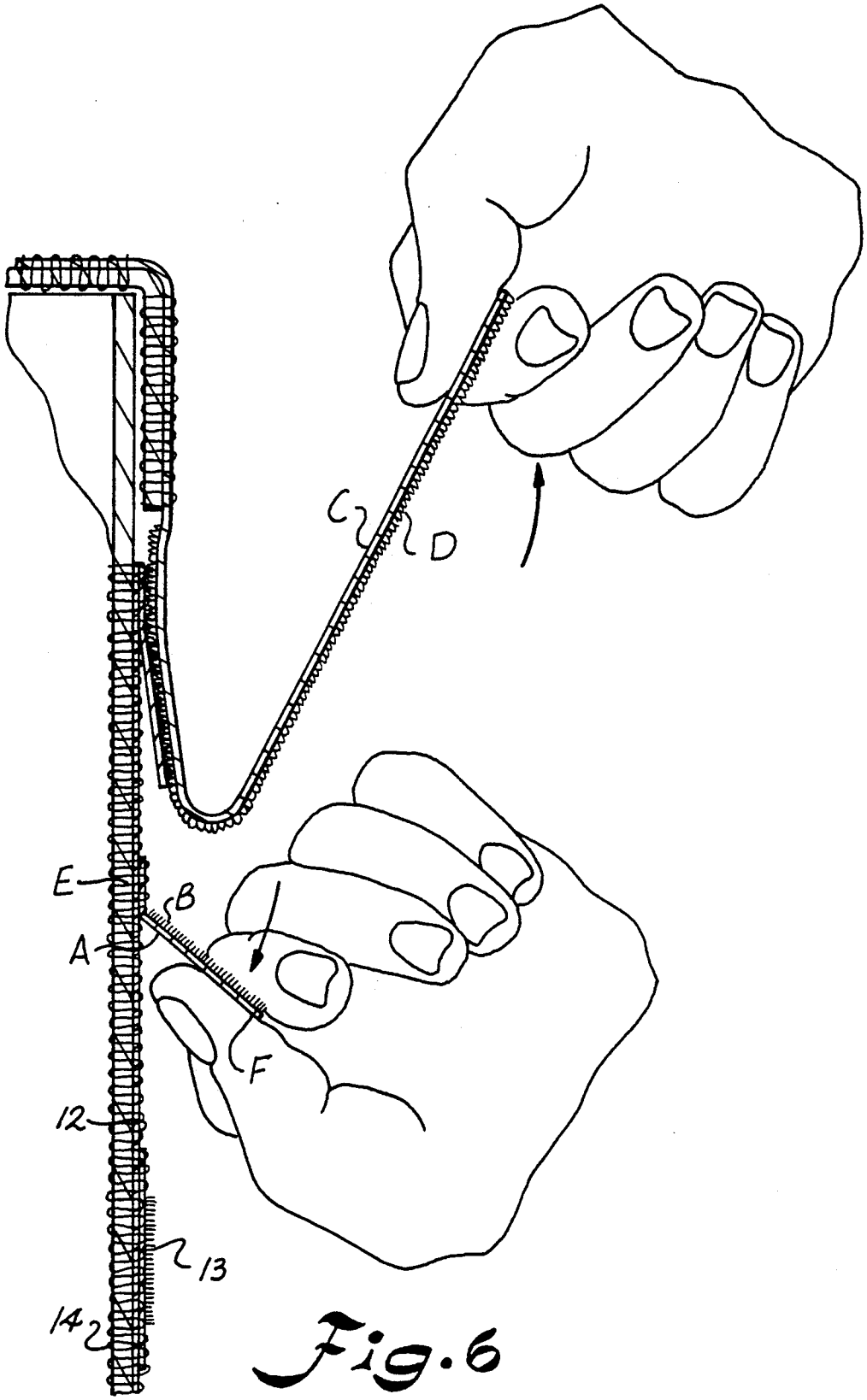
FIG. 6 is an enlarged sectional elevation further illustrating the method wherein the hinged member is peeled away from a freely movable strap.

FIG. 5 illustrates the locking action exerted by the fastener resisting a further upwardly pulling action against a free movable strip C. FIG. 6 illustrates the pulling of the hinged member A from the movable member C for readily achieving an unfastening operation.

Figure 7:
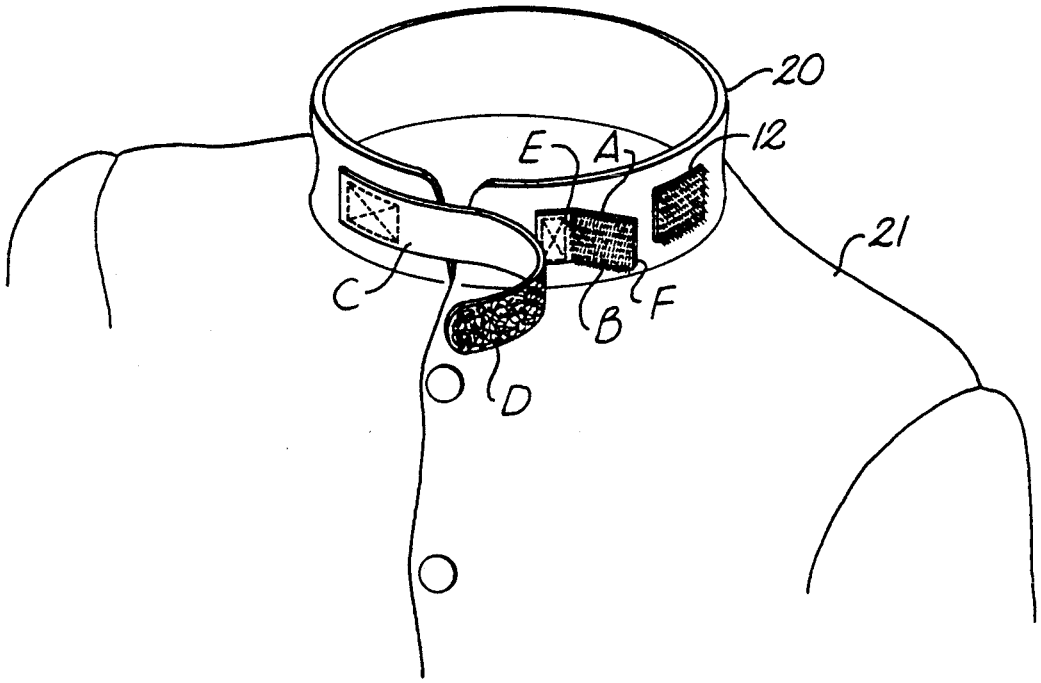
FIG. 7 is a perspective view illustrating another use for a single hinged fastener constructed in accordance with a modified form of the present invention.

FIG. 7 illustrates the use of a single hinged backing member A in order to secure a collar 20 as carried by a coat 21 or other garment and the like. The collar of the coat is illustrated as carrying a base fastener member 12 fixed thereto in alignment with the hinged member for securement by the movable strap C which connects opposed looped Velcro fastening material.

It is thus seen that a Velcro fastener has been provided which is suitable for use in any application requiring that a fastening material be locked against inadvertently unfastening. Such uses may be as many as the uses possessed by contact fasteners and the like including clothing, sporting goods, luggage, tents, back packs, slings and other orthopaedic devices and the like. Contact fasteners other than hook and loop fastening material may be utilized such as those employing pressure sensitive glue or adhesive as fastening material or members. Also, fastener material other than material which is pressure sensitive upon initial application and use, but wherein the securement may be suitably released as by various glues such as pressure sensitive applications may be used.

The force required to disconnect locking fasteners constructed in accordance with the invention in normal use may exceed by many times the force required to disconnect conventional Velcro fasteners.

While a preferred embodiment of the invention has been described using specific terms, such description is for illustrative purposes only, and it is to be understood that changes and variations may be made without departing from the spirit or scope of the following claims.

What is claimed is:

1. A bag with integral locking closure features, comprising:

a bag having an interior receiving portion, a plurality of exterior walls, and a closable top generally opposite a defined front wall of said exterior walls;

a base fastener member, integrally associated with said bag front wall, and having first fastener material supported thereon facing outwardly from said front wall;

a plurality of locking strap members, pivotably supported at respective first ends thereof on said base fastener member at respective staged distances therealong from said bag closable top, said locking strip members having respective first sides pivotable towards said bag closable top, first fastener material supported on said first sides, respective second sides, opposite to said respective first sides, and free of fastener material, respective second ends, opposite to said respective first ends, and freely pivotable towards said bag closable top, and respective tab elements, extending from said respective second ends, and free of fastener material on either side thereof; and a movable closure strap member, associated with said bag closable top, and having a first side positionable in opposition to said base fastener member and carrying thereon second fastener material complementary to said first fastener material, for selective locking engagement simultaneously with said first fastener material as supported on said base fastener member and as supported on said plurality of locking strap members, such that subsequent movement of said movable closure strap member so as to open said bag closable top is successively opposed by said staged plurality of locking strap members unless each respective tab thereof is secured to prevent pivoting movement of its associated locking strap member second end, which tab securement enables that locking strap member stage to be disengaged from said movable closure strap member.

2. A bag as in claim 1, wherein said first fastener material comprises hook fastener material and said second fastener material comprises loop fastener material.

3. A bag as in claim 1, wherein said movable closure strap member is secured to an outer wall portion of said bag closable top.

4. A bag as in claim 1, wherein said plurality of locking strap members is at least two.

5. A locking fastener arrangement utilizing respective complementary forms of fastener materials, comprising:

a base member;

a first movable width of backing having one of said forms of fastener material on one surface thereof extending between first and second opposing ends of said first movable width of backing;

a second movable width of backing having a complementary form of fastener material on a first surface thereof opposable to said one surface of said first movable width of backing; and a transverse hinge pivotably securing said first end of said first movable width of backing in opposable relation with said second movable width of backing in linear alignment therewith along a first direction in a first plane so that said fastener material on said one surface is in position to lockingly engage said complementary fastener material on said first surface, so that an attempt to dislodge locking engagement of said respective complementary fastener materials results in pivoting of said second end of said first movable width of backing outwardly on said transverse hinge and in a second direction generally opposite to said first direction along said first plane, for limiting release of said locking fastener.

6. A locking fastener arrangement as in claim 5, wherein said respective complementary forms of fastener materials comprise hook and loop fastener materials.

7. A locking fastener arrangement as in claim 6, wherein said fastener material on said one surface of said first movable width of backing is hook material and said fastener material on said first surface of said second movable width of backing is loop material.

8. A locking fastener arrangement as in claim 6, wherein a tab free of fastener material extends from said second end of said first movable width of backing, so as to facilitate dislodgement of said locking engagement.

9. A locking fastener arrangement as in claim 8, wherein said base member is secured to an outer side wall of a bag having a closable flap to close an interior portion thereof, and said second movable width of backing is associated with said closable flap, so that said locking engagement results in closure of said flap.

10. A locking fastener arrangement as in claim 9, wherein said base member includes a plurality of transverse hinges spaced thereon and respectively pivotably supporting a corresponding plurality of said first movable widths of backing, each of which include a tab free of fastener material secured to its respective second end.

11. A locking fastener arrangement as in claim 10, wherein said base member includes fastener material carried thereon for securement to said first surface of said second movable width of backing, and wherein surfaces of said first movable widths of backing opposite to said one surface thereof have no fastener material thereon, so as to not lockingly engage said base member fastener material.

12. A locking fastener arrangement as in claim 6, wherein said base member carries a plurality of hinges and respectively pivotably supports therewith a corresponding plurality of said first movable widths of backing, so as to form successive pivoting stages.

13. A locking fastener arrange as in claim 12, wherein said base member is securable to an article to be fastened, and fastening material is attached to said base member for securement to said first surface of said second movable width of backing.

14. A locking fastener arrangement as in claim 6, wherein said base member and said second movable width of backing are integrally associated with a garment collar for selectively closing same.

15. A method of locking a fastener arrangement utilizing respective complementary forms of fastener materials, said method comprising the steps of:

providing a base member;

providing a first movable width of backing having one of said forms of fastener material on one surface thereof extending between first and second opposing ends of said first movable width of backing;

providing a second movable width of backing having a complementary form of fastener material on a first surface thereof opposable to said one surface of said first movable width of backing;

providing a transverse hinge and therewith pivotably securing said first end of said first movable width of backing to said base member, with said first movable width of backing in opposable relation with said second movable width of backing in linear alignment therewith along a first direction in a first plane so that said fastener material on said one surface is in position to lockingly engage said complementary fastener material on said first surface; and selectively fastening together said first and second movable widths of backing by securement of said respective complementary fastener materials thereof, so that an attempt to dislodge said securement locking engagement of said respective complementary fastener materials results in pivoting of said second end of said first movable width of backing outwardly on said transverse hinge and in a second direction generally opposite to said first direction along said first plane, for limiting release of said locking fastener.

16. A method as in claim 15, further including providing said respective complementary forms of fastener materials so as to comprise hook and loop fastener materials.

17. A method as in claim 16, further including the step of subsequently dislodging said locking engagement of said first and second movable widths of backing by securing said first movable width of material against pivoting thereof.

18. A method as in claim 17, wherein said dislodging step includes providing a tab free of fastener material extending from said second end of said first movable width of backing, so as to facilitate dislodgement of said locking engagement.

19. A method as in claim 18, further including the step of securing said base member to an outer side wall of a bag having a closable flap to close an interior portion thereof, and associating said second movable width of backing with said closable flap, so that said locking engagement results in closure of said flap.

20. A method as in claim 19, further including the step of providing said base member with a plurality of transverse hinges spaced thereon and respectively pivotably supporting a corresponding plurality of said first movable widths of backing, each of which include a tab free of fastener material secured to its respective second end, to be used to facilitate subsequent and respective dislodgements of the respective first movable widths of backing.

21. A method as in claim 20, further including the step of providing said base member with fastener material carried thereon for securement to said first surface of said second movable width of backing, and the step of providing surfaces of said first movable widths of backing opposite to said one surface thereof with no fastener material thereon, so as to not lockingly engage said base member fastener material.

22. A method as in claim 17, further including the step of providing said base member with a plurality of hinges carried thereon and respectively pivotably supporting therewith a corresponding plurality of said first movable widths of backing, so as to form successive pivoting stages for limiting release of said locking fastener.

23. A method as in claim 22, further including securing said base member to an article to be fastened, and attaching fastening material to said base member for selective securement thereof to said first surface of said second movable width of backing whenever said fastener is lockingly engaged.

24. A method as in claim 17, further including the step of integrally associating said base member and said second movable width of backing with a garment collar for selectively closing and opening same.

25. A method as in claim 16, further including the step of providing said fastener material on said one surface of said first movable width of backing so as to comprise hook material and providing said fastener material on said first surface of said second movable width of backing so as to comprise loop material.

* * * * *